US005759048A

United States Patent [19]

Korsunsky et al.

[11] Patent Number: 5,759,048

[45] Date of Patent: Jun. 2, 1998

[54] BOARD TO BOARD CONNECTOR

[75] Inventors: Iosif Korsunsky, Harrisburg; Dimitry Grabbe, Middletown; Ronald Steward, Lititz, all of Pa.

[73] Assignee: The Whitaker Corporation, Wilmington, Del.

[21] Appl. No.: 763,492

[22] Filed: Dec. 11, 1996

[51] Int. Cl.[6] ..... H01R 9/09

[52] U.S. Cl. ..... 439/66

[58] Field of Search ..... 439/66, 91, 591

[56] References Cited

U.S. PATENT DOCUMENTS

| | | | |
|---|---|---|---|
| 4,027,935 | 6/1977 | Byrnes et al. | 439/289 |
| 4,330,165 | 5/1982 | Sado | 439/66 |
| 4,505,529 | 3/1985 | Barkus | 439/82 |
| 4,752,231 | 6/1988 | Olsson | 439/66 |
| 4,793,814 | 12/1988 | Zifcak et al. | 439/66 |
| 4,843,315 | 6/1989 | Bayer et al. | 324/158 |
| 5,069,629 | 12/1991 | Johnson | 439/66 |
| 5,248,262 | 9/1993 | Busacco et al. | 439/66 |
| 5,324,205 | 6/1994 | Ahmad et al. | 439/66 |
| 5,498,166 | 3/1996 | Rothenberger | 439/66 |

*Primary Examiner*—Gary F. Paumen
*Assistant Examiner*—T. C. Patel
*Attorney, Agent, or Firm*—Salvatore Anastasi

[57] ABSTRACT

An electrical connector 10 is disclosed for connecting two printed circuit boards 50,60. The electrical connector 10 features a insulative housing 12 having a plurality of contacts 18 disposed in contact-receiving slots 32. The contact-receiving slots 32 extend between the mating faces 22,24 and back to a curved end wall 30. A retainer pin 16 is pressed into a retaining slot 14 of the housing to hold the contacts 18 firmly against the curved end wall 30 at a center point 28. Upon mating, the contact will experience a wiping action across the pads 52,62 of each of the circuit boards.

13 Claims, 4 Drawing Sheets

BOARD TO BOARD CONNECTOR

FIELD OF THE INVENTION

This invention is related to electrical connectors and more particularly to an electrical connector for establishing an electrical connection between two printed circuit boards.

BACKGROUND OF THE INVENTION

It is often desirable to connect an electronic module or a printed circuit board to another printed circuit board in a parallel manner. This is typically accomplished by a board-to-board connector which is mechanically clamped or otherwise secured between two parallel printed circuit boards. An example of such a connector is disclosed in U.S. Pat. No. 4,752,231 by Olsson. Olsson teaches an electrical connector intended for use between spaced apart parallel circuit boards where the connector is formed of a rigid insulative housing having opposed mating faces through which contacts protrude for electrical connection to pads on each of the circuit boards. Each contact has an intermediate spring portion which is within the housing assembly so that the end portions of the contacts can be moved recessively into the housing with accompanying flexure of the spring. The spring portions of the contacts are flexed so that the end portions are urged against the pads of the printed circuit boards to establish electrical connection therebetween.

A similar connector is disclosed by Barkus in U.S. Pat. No. 4,505,529. Barkus teaches a connector including a contact element formed with three elongated beams extended between and connecting contact surfaces at each end. These beams buckle under compression to provide spring forces and electrical connections between the boards.

A problem exists with these designs in that the contacts of these connectors will simply buckle and travel only in the mating direction. Any debris which is present on the pads of the circuit boards may therefore interfere with establishing a reliable electrical connection between the contacts and the pads.

SUMMARY OF THE INVENTION

It is therefore an object of this invention to provide a board-to-board connector which exerts an essentially constant contact force while going from an unmated to a mated condition and which offers a wiping action to eliminate degradation of the electrical connection established between the connector and the printed circuit boards.

This object has been achieved by providing an electrical connector having an insulative housing which is profiled to have a plurality of slots extending between opposed mating faces and through to one side face. Contacts are disposed each in a respective slot and are retained in the housing by a retainer pin which is inserted through the side face into a retainer slot of the insulative housing at a location approximately half way between the opposed mating faces. This retainer pin serves to secure the contacts against an end wall of each slot at a point approximately half way between the opposed mating faces.

BRIEF DESCRIPTION OF THE DRAWINGS

The invention will now be described by way of example with reference to the accompanying figures of which.

DETAILED DESCRIPTION OF THE INVENTION

Figure 1:
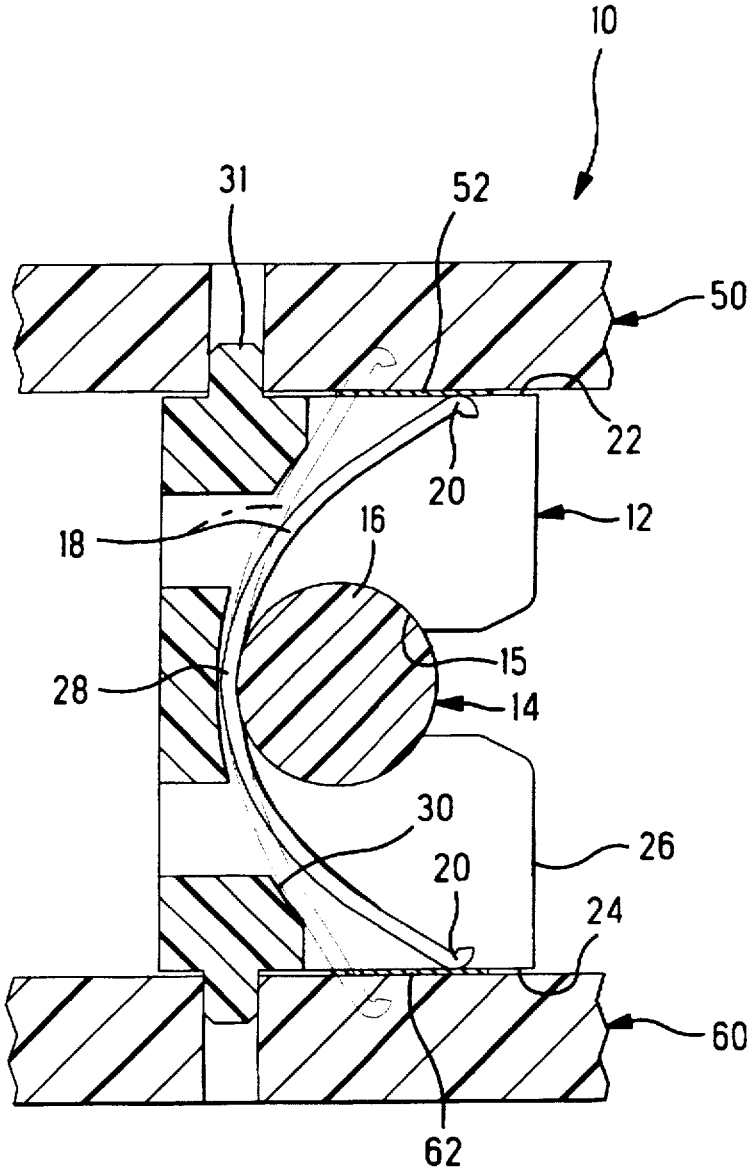
FIG. 1 shows a cross sectional view of the connector according to this invention taken along the line 1—1 of FIG. 2.

Referring first to FIG. 1, the electrical connector 10 is designed for connecting pads 52,62 of two printed circuit boards 50 by applying a compressive force on the two circuit boards 50,60 to capture the connector 10 therebetween.

Figure 3:
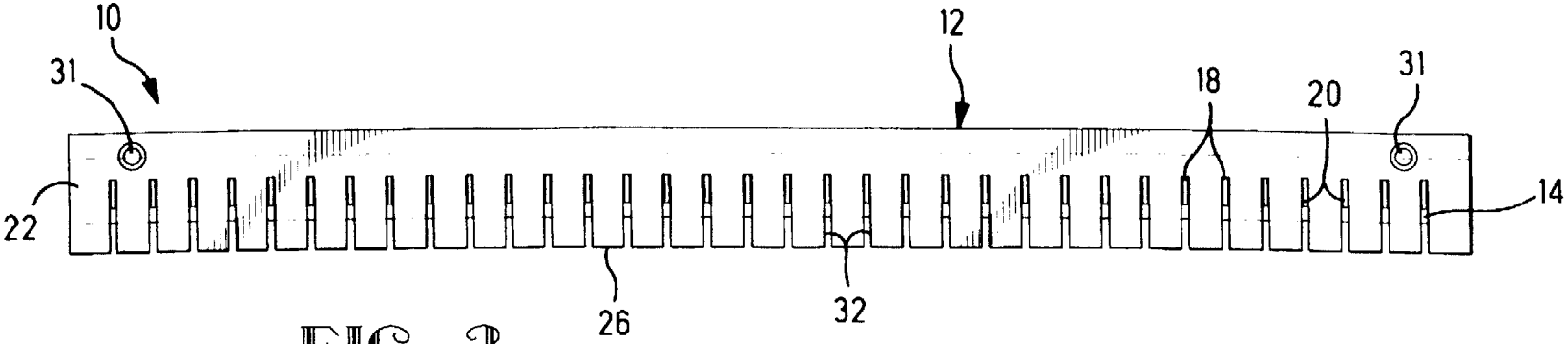
FIG. 3 shows a top view of the electrical connector of FIG. 2.
Figure 2:
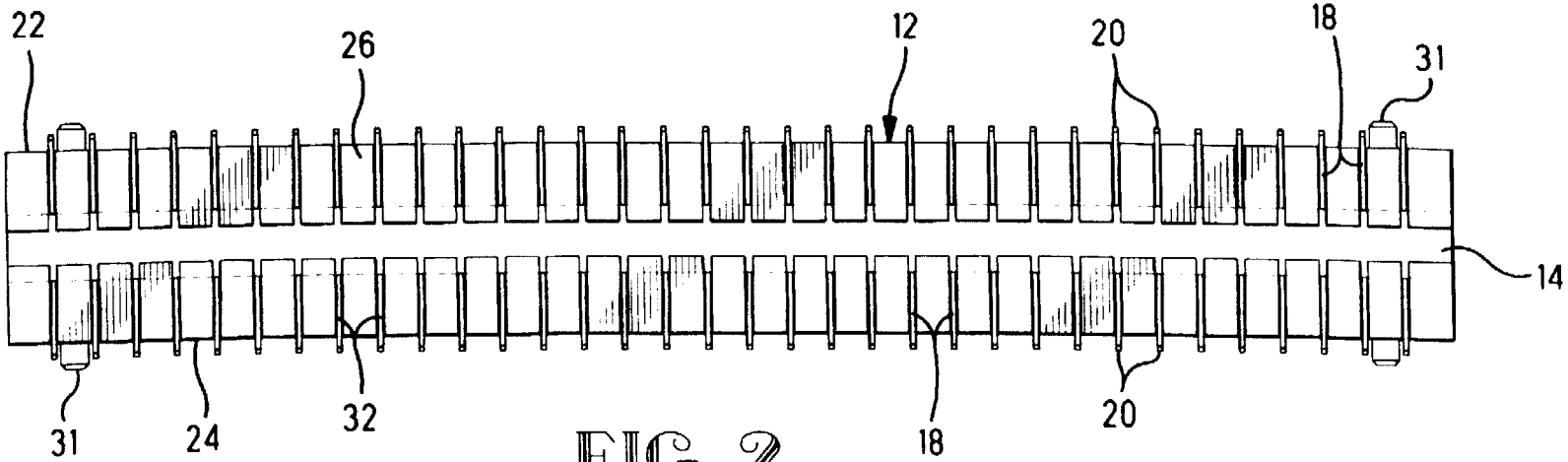
FIG. 2 shows a side view of the electrical connector according to this invention.

Referring now to FIGS. 1, 2, and 3, the insulative housing 12 will be described in greater detail. The insulative housing 12 is profiled to have a plurality of slots 32 extending between a pair of mating faces 22,24 and inward from a side face 26. Each slot extends from the side face 26 inward to a curved end wall 30. A retainer slot 14 is provided along the entire length of the housing 12 and extends from the side face 26 into the housing toward the curved end wall 30. The retainer slot 14 is profiled to have a semicircular securing section 15 adjacent the end walls 30. Optional alignment projections 31 may be provided on the mating faces 22,24 to properly position the connector 10 between the printed circuit board 50,60.

A plurality of contacts 18 are disposed each in a respective slot 32 and extend from a center point 28, in opposing directions beyond each mating face 22,21. Each contact 18 has a curved contact point 20 disposed at its free end.

A retainer pin 16 being generally cylindrically shaped and formed of a rigid insulative material is disposed inside the retainer slot 14 and is secured into the housing 12 by a semi-circular securing section 15.

Assembly of the connector 10 will now be described in greater detail. A series of contacts 18 are formed by simply loading lengths of wire into each slot 32 of the housing 12. Each inserted wire must extend well beyond each mating face 22,24 of the housing. The retainer pin 16 is then urged into the retainer slot 14 such that it will bend each contact 18 at the center point 28 to generally conform to the shape of the curved end wall 30 of each slot 32 and secure each contact between the pin 16 and the end wall 30 at the center point 28. Once secured, the contacts 18 can be cut using a single tool motion to cut off the excess wire and also achieve a radius at the contact point 20. Assembly of the connector 10 is thus completed. It should be noted at this point that the contacts 18 are in a preloaded condition. This improves the force vs. displacement characteristics of the connector 10.

Figure 4:
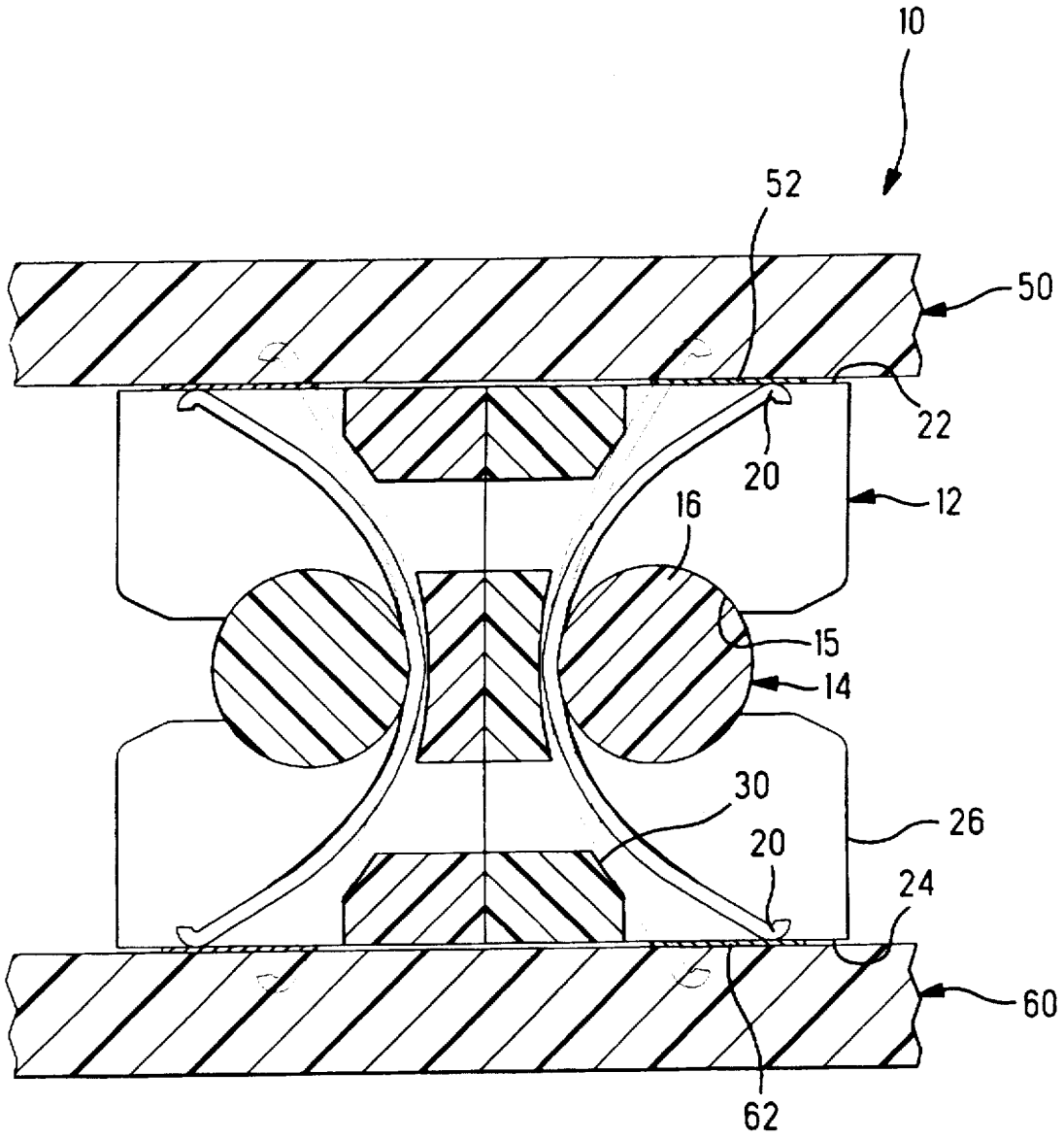
FIG. 4 shows a cross-sectional view similar to FIG. 1 having two connector housings.

Referring again to FIG. 1, the contact 28 is shown both in the relaxed unmated position, in phantom, and in the loaded mated position, sandwiched between two printed circuit boards 50,60. It should be noted that in traveling from the unmated position to the mated position, the contact points 20 will exert a generally constant contact force against, and wipe across each of the contact pads 52,62 of the printed circuit board thus removing any debris which may adversely affect the electrical connection Referring now to FIG. 4, a pair of connector housings 12 are shown placed back to back between printed circuit boards 50,60. It should be noted that the optional alignment projections 31 have been removed. The housings 12 are properly positioned against pads 52,62 of the printed circuit boards 50,60 because upon compression during the mating cycle, each of the housings 12 will be urged towards each other to maintain proper positioning.

Figure 5:
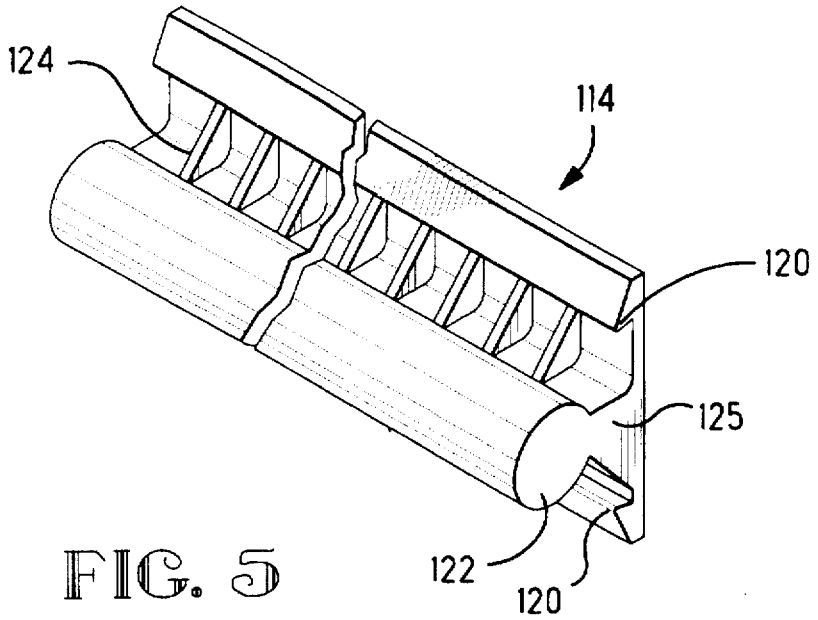
FIG. 5 shows a three-dimensional view of a stabilizer for use in an alternate embodiment.
Figure 6:
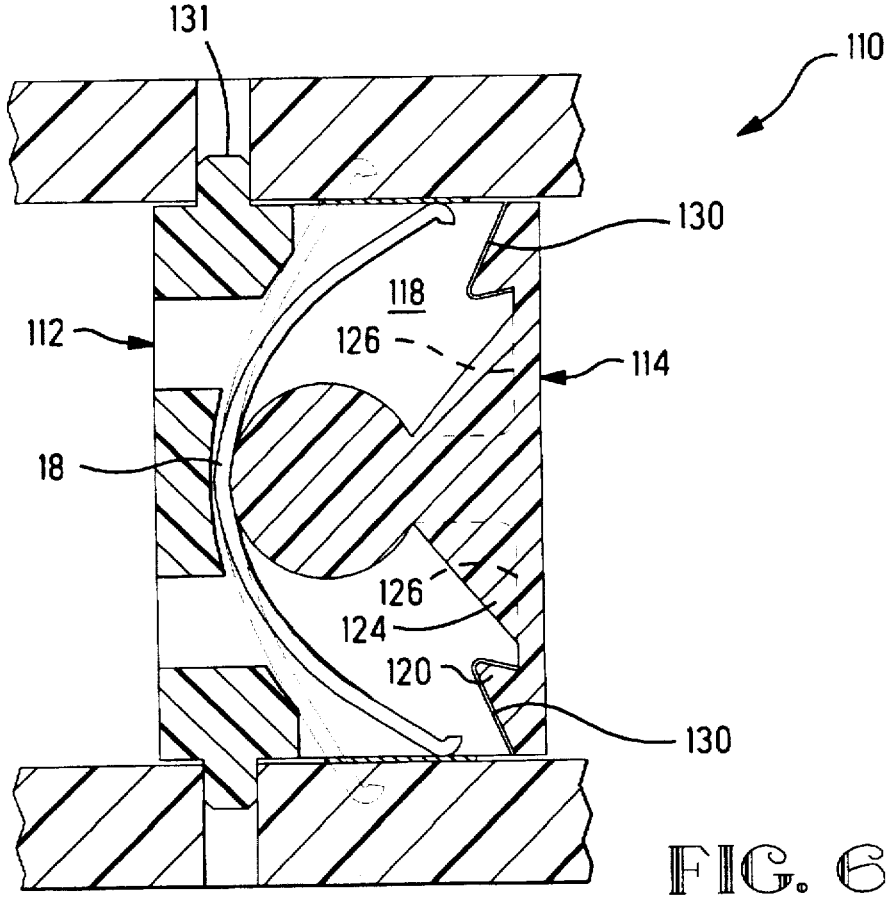
FIG. 6 shows a cross-sectional view similar to that of FIG. 1 for the alternate embodiment of the present invention.

An alternate embodiment of the present invention is shown in FIGS. 5 and 6. A stabilizing member 114 is shown in FIG. 5 having a pin section 122 extending from the body 125. The body 125 is generally P shaped having a pair of securing shoulders 120 extending from opposing arms along the entire length of the securing member 114. Alignment ribs 124 extend from the body 125 transverse to the pin section 122, the alignment ribs 124 being disposed at locations corresponding to contact-receiving slots 118. Each alignment rib 124 is therefore profiled to extend into a respective a contact-receiving slot 118 from the side face 126 of the housing 112.

FIG. 6 shows the stabilizing member 114 assembled to the housing 112. It should be noted that the alternate housing 112 is formed exactly as that of FIG. 1 except for the addition of securing channels 130 formed along the length of the side face 126, each proximate one of the mating faces 22,24. The advantage of this embodiment is that it serves to prevent flexing of the insulative housing 112 in applications where the housing 112 must be dimensioned to fit in a very small area of the printed circuit board and therefore has very thin walls.

The advantage of this invention is that it achieves a constant mating force across the contact through the entire mating cycle while achieving a wiping action to remove debris which may adversely affect electrical connection.

We claim:

1. An electrical connector for interconnecting two parallel printed circuit boards comprising:

an insulative housing profiled to have a plurality of contact slots for receiving a plurality of contacts having free ends extending beyond a pair of opposed mating faces, each of the contact slots extending between the mating faces and inward from a side wall to a curved end wall, a retainer slot extending across the connector housing transverse to each of the contact-receiving slots and inward from a side surface, a retainer pin being generally cylindrically shaped and formed of a ridged insulative material disposed inside the retainer slot such that it captivates the plurality of electrical contacts each inside the respective contact slot at a point between each contact free end.

2. The electrical connector as recited in claim 1 wherein the contacts are formed of a bendable wire.

3. The electrical connector as recited in claim 1 wherein the retainer slot comprises a semicircular pin retaining section adjacent the end wall of each contact slot.

4. An electrical connector for establishing electrical connection between a plurality of contact pads on opposing parallel circuit boards comprising:

an insulative housing having a plurality of contact slots extending between opposed mating faces and inward from a side face to a curved end wall, a plurality of contacts disposed in respective contact slots, a retaining pin being generally cylindrically shaped and formed of a ridged insulative material disposed in a retaining slot of the insulative housing which extends transverse to the contact slots and partially through each contact slot, whereby the retaining pin serves to urge the contacts against respective curved walls and secure the contacts in respective contact slots against the respective curved walls.

5. The electrical connector as recited in claim 4 wherein the contacts are formed of a bendable wire.

6. The electrical connector as recited in claim 4 wherein the retainer slot comprises a semicircular pin retaining section adjacent the end wall of each contact slot.

7. The electrical connector as recited in claim 4 wherein the contacts are formed of a bendable wire.

8. A method of assembling a board to board electrical connector comprising the steps of:

providing an insulative housing having a retainer slot profiled to have a retainer pin securing area and a plurality of contact slots extending from a side face to a curved end wall and between opposed mating faces, inserting a plurality of bendable wires into respective contact slots such that free ends of each wire extend beyond each opposed mating face, inserting an insulative retainer pin into the retainer slot, urging the retainer pin further into the retainer slot to engage the bendable wires and force the bendable wires against each of the respective curved end walls to form generally C-shaped contacts, securing the retainer pin in the retainer pin securing area, cutting and forming the free ends of the bendable wires to form radiused contact points which lie in a common mating plane.

9. An electrical connector for establishing electrical connection between a plurality of contact pads on opposing parallel circuit boards comprising:

an insulative housing having a plurality of contact slots extending between opposed mating faces and inward from a side face to a curved end wall, a plurality of contacts disposed in respective contact slots, a stabilizing member disposed in a slot of the insulative housing which extends transverse to the contact slots and partially through each contact slot, whereby the stabilizing member serves to form the contacts during assembly by urging the contacts against respective curved walls and secure the contacts in respective contact slots against the respective curved walls.

10. The electrical connector as recited in claim 9 wherein the stabilizing member comprises a body having a pin section extending therefrom into the slot of the insulative housing.

11. The electrical connector as recited in claim 10 wherein the stabilizing member further comprises at least one securing shoulder extending from the body for cooperation with a complementary recess on insulative housing side face.

12. The electrical connector as recited in claim 10 wherein the stabilizing member further comprises a plurality of alignment ribs extending from the body each into a respective contact slot of the insulative housing.

13. The electrical connector as recited in claim 9 wherein the retainer slot comprises a semicircular pin retaining section adjacent the end wall of each contact slot.

* * * * *